US011447303B2

(12) United States Patent
Wang

(10) Patent No.: US 11,447,303 B2
(45) Date of Patent: Sep. 20, 2022

(54) FLIP COVER FOR WET WIPES

(71) Applicant: Top Green World Packaging Co., Ltd., Gelu (CN)

(72) Inventor: Ling-da Wang, Gelu (CN)

(73) Assignee: TOP GREEN WORLD PACKAGING CO., LTD., Gelu (CN)

( * ) Notice: Subject to any disclaimer, the term of this patent is extended or adjusted under 35 U.S.C. 154(b) by 288 days.

(21) Appl. No.: 16/822,945

(22) Filed: Mar. 18, 2020

(65) Prior Publication Data

US 2020/0299037 A1 Sep. 24, 2020

(30) Foreign Application Priority Data

Mar. 18, 2019 (CN) ..... 2019203361423.3

(51) Int. Cl.
*B65D 83/08* (2006.01)
*B65D 43/16* (2006.01)
*A47K 10/32* (2006.01)

(52) U.S. Cl.
CPC ..... *B65D 43/16* (2013.01); *A47K 10/32* (2013.01); *B65D 83/0805* (2013.01); *A47K 2010/3266* (2013.01)

(58) Field of Classification Search
CPC ..... A47K 2010/3266; A47K 10/32; B65D 2251/10; B65D 2543/00296; B65D 2543/00453; B65D 2543/00759; B65D 2543/00101; B65D 2543/00629; B65D 43/163
USPC ..... 220/810
See application file for complete search history.

(56) References Cited

U.S. PATENT DOCUMENTS

2015/0217931 A1* 8/2015 Wada ..... B65D 83/0805 206/494
2016/0159534 A1* 6/2016 Ujiie ..... B65D 75/5894 220/254.3

* cited by examiner

*Primary Examiner* — King M Chu
(74) *Attorney, Agent, or Firm* — Muncy, Geissler, Olds & Lowe, P.C.

(57) ABSTRACT

The present Utility Model discloses a flip cover for wet wipes, comprising an upper flip cover and a lower drawing cover, wherein the lower drawing cover is provided with a drawing port, the upper flip cover comprises a fixing cover, a flip cover and a connecting elastic bar, the two ends of the connecting elastic bar are connected with the fixing cover and the flip cover, respectively, the lower surface of the fixing cover is provided with a downward convex insert strip, and the fixing cover is connected to the lower drawing cover through the insert strip; the front end of the flip cover is provided with an internally concave upper clipping strip and is elastically engaged with the lower drawing cover through the clipping strip; the upper surface of the connecting elastic bar is provided with convex strips which are extruded from the upper surface of the connecting elastic bar and are supported against the upper edge of the slot of the fixing cover after the flip cover is turned to a certain angle; when the applying force drives the flip cover to a certain angle, the flip cover upwards and automatically turns along the connection edges of the elastic bar and the fixing cover under the drive of the connecting elastic bar; and when the applying force is released within certain angle, the flip cover will automatically and downwards turn and be engaged with the lower drawing cover under the drive of the connecting elastic bar.

5 Claims, 4 Drawing Sheets

FLIP COVER FOR WET WIPES

TECHNICAL FIELDS

The Utility Model relates the field of wet wipe box, more specifically, a flip cover for wet wipes.

BACKGROUND TECHNOLOGY

Whether the wet wipe box is convenient depends largely on the flip cover for wet wipes on the wet wipe box. However, the existing flip cover for wet wipes generally comprises an upper flip cover and a lower drawing cover. The upper flip cover is generally directly connected with the lower drawing cover through injection molding or a connecting rod. During the use, the upper flip cover needs to be pushed upward and unfolded by force and pressed by downward force to keep the upper flip cover in a fully unfolded state; in the closed state, it is also necessary to apply force on the upper flip cover to completely turn it over and apply pressure on the upper flip cover to ensure it is locked tightly with the lower drawing cover. Therefore, the existing flip cover for wet wipes is inconvenient to use; once the user fails to pay attention to or apply force to meet the requirement, the upper flip cover is not closed in time, and the wet wipe will lose water and breed bacteria.

SUMMARY

Due to the above problems existing in the prior art, the Utility Model provides a flip cover for wet wipes, which aims to automatically close when the upper flip cover is opened and forgets to close, so as to prevent moisture loss of the wet wipe and bacteria growth.

The Utility Model solves the above problems through the following technical solution:

A flip cover for wet wipes, comprising an upper flip cover and a lower drawing cover, wherein the lower drawing cover is provided with a drawing port, the upper flip cover comprises a fixing cover, a flip cover and a connecting elastic bar, the two ends of the connecting elastic bar are connected with the fixing cover and the flip cover, respectively, the lower surface of the fixing cover is provided with a downward convex insert strip, and the fixing cover is connected to the lower drawing cover through the insert strip; the front end of the flip cover is provided with an internally concave upper clipping strip and is elastically engaged with the lower drawing cover through the clipping strip; the upper surface of the connecting elastic bar is provided with convex strips which are extruded from the upper surface of the connecting elastic bar and are supported against the upper edge of the slot of the fixing cover after the flip cover is turned to a certain angle; when the applying force drives the flip cover to a certain angle, the flip cover upwards and automatically turns along the connection edges of the elastic bar and the fixing cover under the drive of the connecting elastic bar; and when the applying force is released within certain angle, the flip cover will automatically and downwards turn and be engaged with the lower drawing cover under the drive of the connecting elastic bar.

Preferably, the lower drawing cover is provided with a drawing port penetrating the lower drawing cover, and a drawing cavity with two layers of step outer edges is formed downward on the outer periphery of the drawing port and on the upper surface of the lower drawing cover; a socket for inserting the insert strip is arranged on the first layer of step, and the socket does not penetrate the lower surface of the low drawing cover; a lower clipping strip is arranged on the second layer of step and at the drawing port, and the lower clipping strip is elastically blocked with the upper clipping strip; and a flexible insulator is upwards and integrally injected along the inner wall of the drawing port, and the height of the insulator exceeds the surface of the first layer of step.

Preferably, the shape of the drawing cavity is matched with the size and outline of the upper flip cover.

Preferably, a downward turnover edge is set at the periphery of the flip cover, and the inner surface of one edge of the flip cover connected with the connecting elastic bar is provided with a downwards convex gear strip; and when the upper flip cover and the lower drawing cover are closed, the flip edge abuts on the first layer of step, the gear strip is positioned outside the insulator, and the gear strip pushes against and supports the insulator.

Preferably, the angle is 90°.

Due to the adoption of the above technical solutions, the Utility Model improves the structure of the upper flip cover, increases the connecting elastic bar and realizes the function of automatic closing through the connecting elastic bar, and it is convenient to use and can prevent moisture loss of wet wipes and breeding of bacteria.

SPECIFIC EMBODIMENTS

In the following description, the technical solution of the Utility Model will be further explained in detail through embodiments and with reference to the attached drawings.

Figure 4:
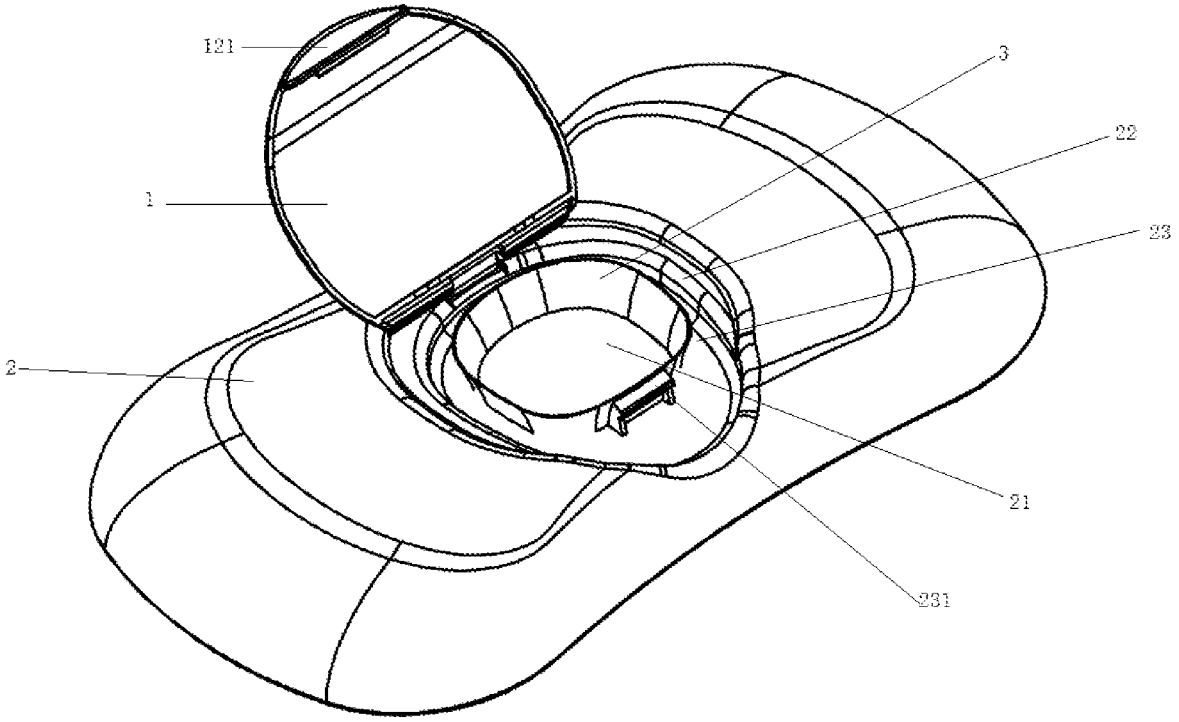
FIG. 4 is a structural schematic diagram IV of the flip cover for wet wipes of the Utility Model.

Refer to FIG. 4, the flip cover for wet wipes of the present application. As shown in FIG. 4, the application comprises an upper flip cover 1 and a lower drawing cover 2 connected with the upper flip cover 1, wherein the lower drawing cover 2 is provided with a drawing port 21, and the wet wipes are pulled out from the drawing port 21.

Figure 1:
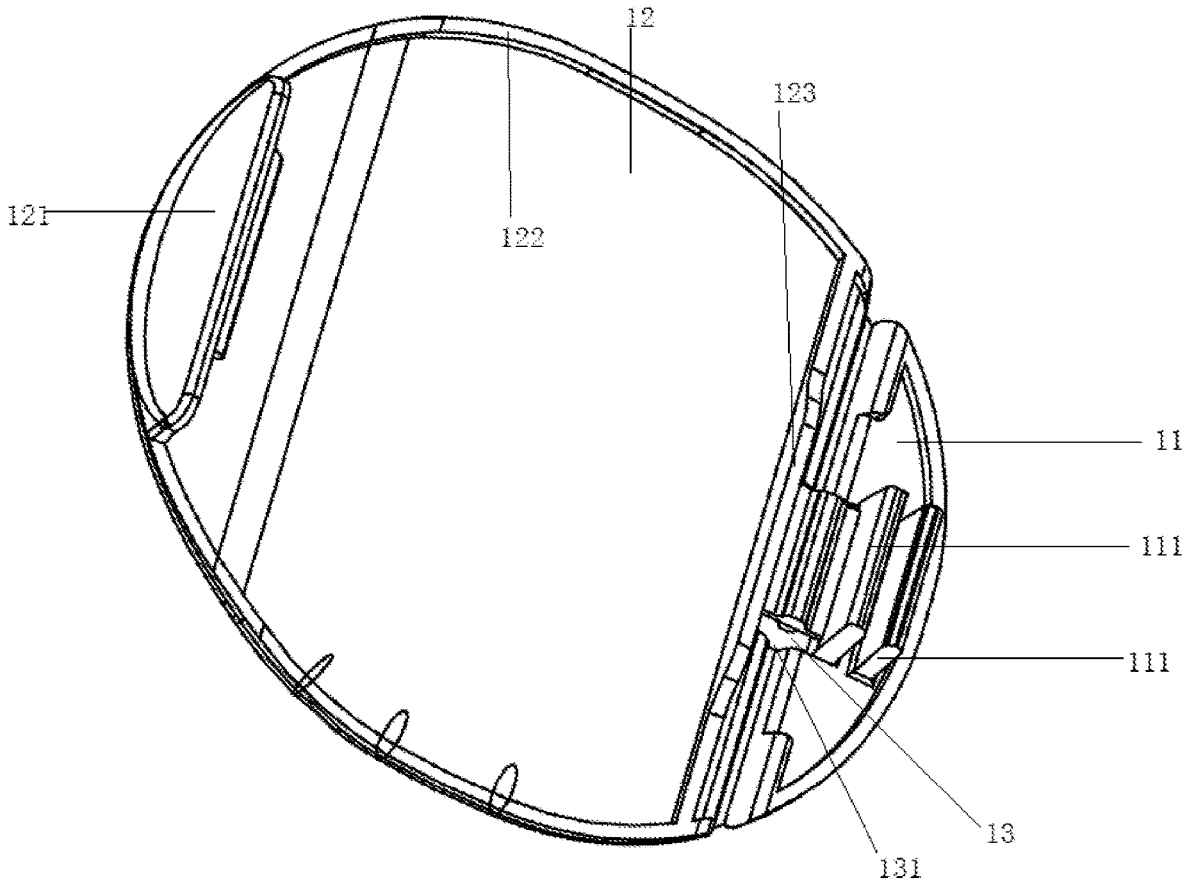
FIG. 1 is a structural schematic diagram I of the upper flip cover of the Utility Model.
Figure 2:
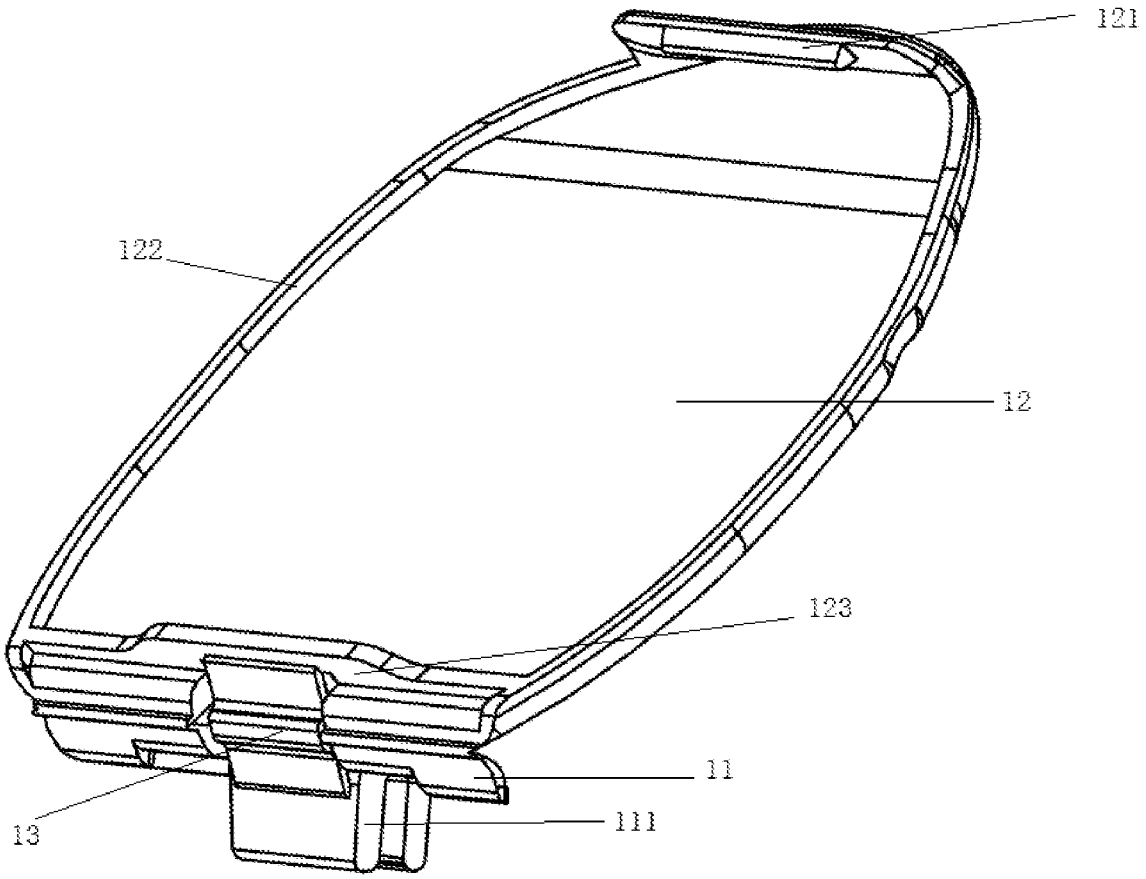
FIG. 2 is a structural schematic diagram II of the upper flip cover of the Utility Model.

As shown in FIGS. 1 and 2, the upper flip cover 1 includes a fixing cover 11, a flip cover 12, and a connecting elastic bar 13. The fixing cover 11 and the flip cover 12 are inwards provided with slots along the butted edges, respectively, and the two ends of the connecting elastic bar 13 are located in the slots and the two ends of the connecting elastic bar 13 are connected with the fixing cover 11 and the flip cover 12, respectively.

The lower surface of the fixing cover 11 is provided with a downwards convex insert strip 111, and the fixing cover 11 is connected to the lower drawing cover 2 through the insert strip 111. The front end of the flip cover 12 is provided with an inwards concave upper clipping strip 121 and is elastically engaged with the lower drawing cover 2 through the upper clipping strip 121.

Figure 3:
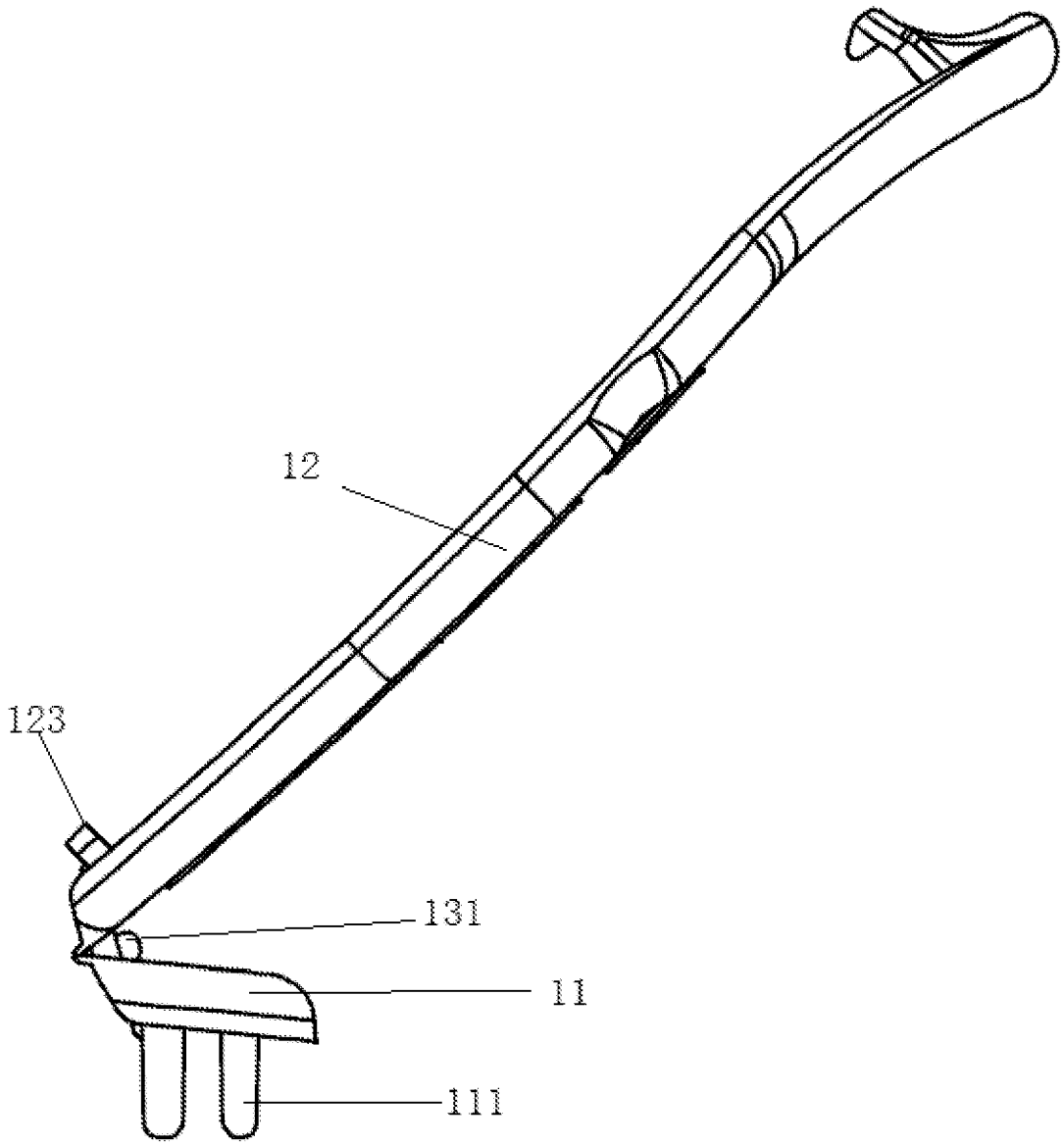
FIG. 3 is a structural schematic diagram III of the upper flip cover of the Utility Model.

Referring to FIG. 3, the upper surface of the connecting elastic bar 13 is provided with a convex strip 131 protruding from the upper surface of the connecting elastic bar 13, and the convex strip 131 abuts against the upper edge of the slot 11 of the fixing cover 11 after the flip cover 12 is turned to a certain angle. The connecting elastic bar 13 has certain elasticity. When the connecting elastic bar 13 is stretched to a certain angle, the connecting elastic bar 13 will automatically turn upward along the turning angle until the convex strip 131 is clamped to the upper edge of the slot 11. However, when the connecting elastic bar 13 is not turned over to a certain angle, the applying force is released, and the quick reset of the connecting elastic bar 13 will drive the flip cover 12 to turn down hard until it is closed. Therefore, when the applying force drives the flip cover 12 to a certain angle, the flip cover 12 upwards and automatically turns along the connection edges of the elastic bar 13 and the fixing cover 11 under the drive of the connecting elastic bar 13; and when the applying force is released within certain angle, the flip cover 12 will automatically and downwards turn and be engaged with the lower drawing cover 11 under the drive of the connecting elastic bar 13. The angle is preferably 90° from the convenience of use and the elastic strength of the connecting elastic bar.

Figure 5:
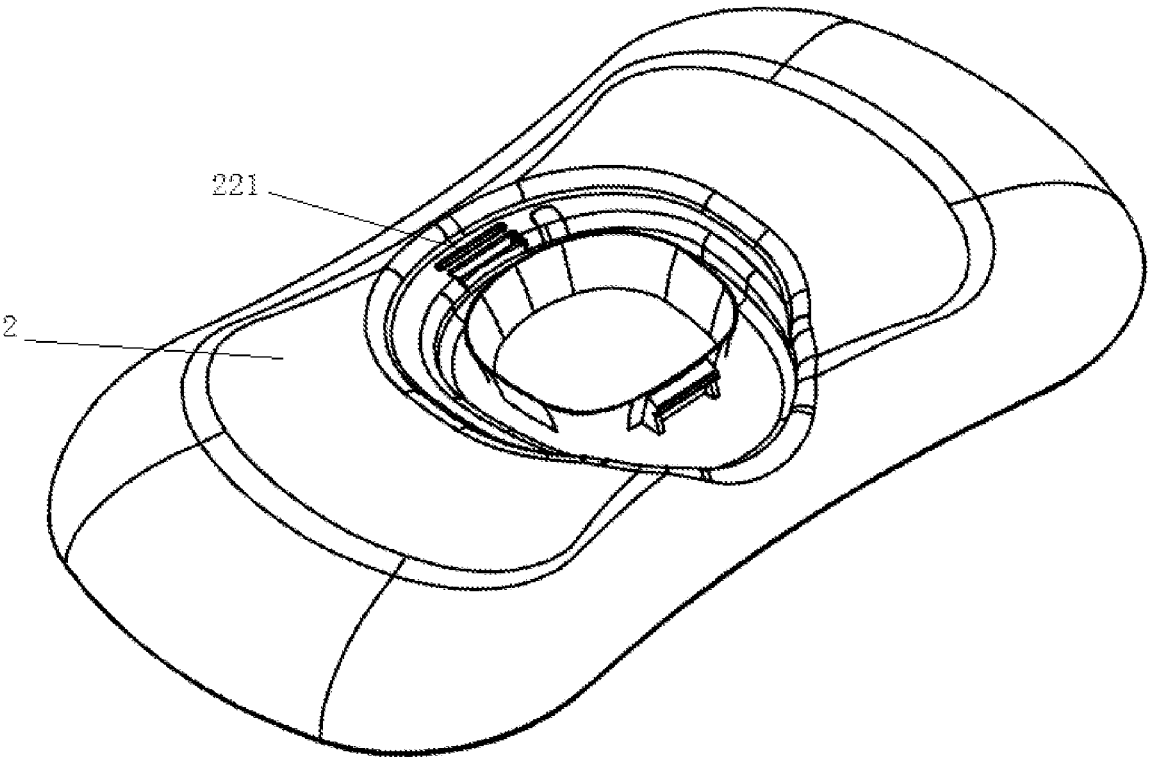
FIG. 5 is a structural schematic diagram of the lower drawing cover of the Utility Model.

Referring to FIG. 5, the lower drawing cover 2 is provided with a drawing port 21 penetrating the lower drawing cover 2, and a drawing cavity with two layers of step outer edges is formed downward on the outer periphery of the drawing port 21 and on the upper surface of the lower drawing cover 2. The shape of the drawing cavity is matched with the size and outline of the upper flip cover.

The first layer of step 22 is provided with a socket 221 into which the insert strip 111 is inserted and the socket 221 does not penetrate the lower surface of the lower drawing cover 2. A lower clipping strip 231 is formed on the second layer of step 23 and located at the drawing port 21, and the lower clipping strip 231 is elastically clamped with the upper clipping strip 121, so that the whole drawing port can be closed. A flexible insulator 3 is integrally molded upward along the inner wall of the drawing port 21, and the height of the insulator 3 exceeds the surface of the first layer of step 22. When the upper flip cover 1 and the lower drawing cover 2 are closed, the upper end of the flexible insulator is abutted against the lower surface of the flip cover 1 to isolate air and bacteria from entering and prevent water loss.

Referring to FIGS. 1 and 2, a downward turnover edge 122 is set at the periphery of the flip cover 12, and the inner surface of one edge of the flip cover 12 connected with the connecting elastic bar 13 is provided with a downwards convex gear strip 123; and when the upper flip cover 1 and the lower drawing cover 2 are closed, the flip edge 122 abuts on the first layer of step 122, the gear strip 123 is positioned outside the insulator 3, and the gear strip 123 pushes against and supports the insulator 3.

The Utility Model improves the structure of the upper flip cover, increases the connecting elastic bar and realizes the function of automatic closing through the connecting elastic bar, and it is convenient to use and can prevent moisture loss of wet wipes and breeding of bacteria.

The above-mentioned embodiments are only used to illustrate the Utility Model and are not used to limit the scope of the Utility Model. Equal changes and modifications made to the Utility Model by those skilled in the art shall fall within the scope of the claims attached to the Utility Model.

The invention claimed is:

1. A flip cover for wet wipes, comprising an upper flip cover and a lower drawing cover connected with the upper flip cover and provided with a drawing port, wherein the upper flip cover comprises a fixing cover, a flip cover and a connecting elastic bar, the fixing cover and the flip cover are inwards provided with slots along butted edges, respectively, and the connecting elastic bar is located in the slot and two ends of the connecting elastic bar are connected with the fixing cover and the flip cover, respectively;

two ends of a lower surface of the fixing cover are respectively provided with a insert strip and an upper clipping portion, and the fixing cover is connected to the lower drawing cover through the insert strip, and the fixing cover is elastically engaged with the lower drawing cover through the upper clipping portion;

an upper surface of the connecting elastic bar is provided with a convex strip protruded from the upper surface of the connecting elastic bar, and the convex strip supports against an upper edge of the slot of the fixing cover after the flip cover is turned to an angle from a horizontal plane in line with the flip cover when the flip cover is laid on a horizontal surface; when an applying force drives the flip cover upwards to the angle, the flip cover upwards turns along connection edges of the elastic bar and the fixing cover under the drive of the connecting elastic bar; and when the applying force is released within the angle, the flip cover downwards turn and is engaged with the lower drawing cover under the drive of the connecting elastic bar.

2. The flip cover for wet wipes according to claim 1, wherein the lower drawing cover is provided with a drawing port penetrating the lower drawing cover, and a drawing cavity with first and second layers of step outer edges is formed downward on the outer periphery of the drawing port and on an upper surface of the lower drawing cover; a socket for inserting the insert strip is arranged on the first layer of step outer edges, and the socket does not penetrate the lower surface of the low drawing cover; a lower clipping strip is arranged on the second layer of step outer edges and at the drawing port, and the lower clipping strip is elastically blocked with the upper clipping portion; and a flexible insulator is integrally injected along an inner wall of the drawing port, and the height of the insulator exceeds a surface of the first layer of step outer edges.

3. The flip cover for wet wipes according to claim 2, wherein the drawing cavity is matched with the upper flip cover.

4. The flip cover for wet wipes according to claim 2, wherein a downward turnover edge is set on the lower surface of the flip cover, and an inner surface of one edge of the flip cover connected with the connecting elastic bar is provided with a downwards convex gear strip; and when the upper flip cover and the lower drawing cover are closed, the flip edge abuts on the first layer of step outer edges, the gear strip is positioned outside the insulator, and the gear strip pushes against and supports the insulator.

5. The flip cover for wet wipes according to claim 1, wherein the angle is 90°.

* * * * *